US010385293B2

(12) United States Patent
Bewick et al.

(10) Patent No.: US 10,385,293 B2
(45) **Date of Patent: *Aug. 20, 2019**

(54) AUTOMATIC DISHWASHING DETERGENT COMPOSITION

(71) Applicant: The Procter & Gamble Company, Cincinnati, OH (US)

(72) Inventors: Lindsay Suzanne Bewick, Tyne & Wear (GB); Alan Thomas Brooker, Newcastle upon Tyne (GB); James Elliot Goodwin, Newcastle upon Tyne (GB); Stefano Scialla, Strombeek Bever (BE); Philip Frank Souter, Northumberland (GB); Glenn Steven Ward, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 2 days.

This patent is subject to a terminal disclaimer.

(21) Appl. No.: 15/619,560

(22) Filed: Jun. 12, 2017

(65) Prior Publication Data

US 2017/0362546 A1 Dec. 21, 2017

(30) Foreign Application Priority Data

Jun. 17, 2016 (EP) ..... 16175137

(51) Int. Cl.

| | |
|---|---|
| ***C11D 3/37*** | (2006.01) |
| ***C11D 1/825*** | (2006.01) |
| ***C11D 3/28*** | (2006.01) |
| ***C11D 3/36*** | (2006.01) |
| ***C11D 3/386*** | (2006.01) |
| ***C11D 17/04*** | (2006.01) |
| *C11D 1/72* | (2006.01) |
| *C11D 1/74* | (2006.01) |

(52) U.S. Cl.

CPC ..... *C11D 3/3769* (2013.01); *C11D 1/8255* (2013.01); *C11D 3/28* (2013.01); *C11D 3/361* (2013.01); *C11D 3/37* (2013.01); *C11D 3/3723* (2013.01); *C11D 3/3776* (2013.01); *C11D 3/386* (2013.01); *C11D 17/042* (2013.01); *C11D 17/045* (2013.01); *C11D 1/72* (2013.01); *C11D 1/74* (2013.01)

(58) Field of Classification Search

CPC ..... C11D 3/3769

USPC ..... 510/475

See application file for complete search history.

(56) References Cited

U.S. PATENT DOCUMENTS

| | | | | |
|---|---|---|---|---|
| 4,765,916 | A | 8/1988 | Ogar, Jr. et al. | |
| 4,972,017 | A | 11/1990 | Smith et al. | |
| 5,453,216 | A | 9/1995 | Kellett | |
| 6,727,215 | B2 | 4/2004 | Roberts et al. | |
| 7,160,947 | B2 | 1/2007 | Claesson et al. | |
| 8,163,686 | B2 | 4/2012 | Gibis et al. | |
| 8,623,806 | B2 | 1/2014 | Scialla et al. | |
| 8,969,284 | B2 | 3/2015 | Wang et al. | |
| 2002/0198125 | A1 | 12/2002 | Jones | |
| 2004/0259749 | A1 | 12/2004 | Braeckman et al. | |
| 2005/0113280 | A1* | 5/2005 | Reddy | C11D 3/0036 510/475 |
| 2008/0193999 | A1 | 8/2008 | Andersen et al. | |
| 2008/0293610 | A1 | 11/2008 | Shaw et al. | |
| 2011/0081454 | A1 | 4/2011 | Hommes et al. | |
| 2011/0143986 | A1 | 6/2011 | Brooker et al. | |
| 2011/0143988 | A1 | 6/2011 | Brooker et al. | |
| 2014/0315775 | A1 | 10/2014 | Hommes et al. | |
| 2016/0060611 | A1 | 3/2016 | Alekseyev et al. | |
| 2017/0174803 | A1 | 6/2017 | Pirrung et al. | |

FOREIGN PATENT DOCUMENTS

| | | | |
|---|---|---|---|
| EP | 0 560 519 | A2 | 9/1993 |
| JP | 2003 183694 | A | 7/2003 |
| JP | 2005-154716 | A | 6/2005 |
| JP | 2006-152287 | A | 6/2006 |
| JP | 2007-238921 | A | 9/2007 |
| WO | WO 2007/044993 | A2 | 4/2007 |
| WO | WO 2007/051989 | A1 | 5/2007 |
| WO | WO 2007/083141 | A1 | 7/2007 |
| WO | WO 2008/053191 | A1 | 5/2008 |
| WO | WO2013025742 | A1 | 2/2013 |

OTHER PUBLICATIONS

Extended European Search Report; Application No. 16175137.5-1375; dated May 12, 2016; 8 pages.

Miyake M: "Agent for quick-drying hard surfaces such as glass and soft surfaces such as head hair contains cationic portion with cationic copolymerized polymer and alkylene oxide group containing portion", WPI/THOMSON, vol. 2004, No. 6, Nov. 21, 2000, XP002762452.

* cited by examiner

*Primary Examiner* — Gregory E Webb

(74) *Attorney, Agent, or Firm* — John T. Dipre

(57) ABSTRACT

An automatic dishwashing detergent composition having a pH as measured in 1% weight aqueous solution at 25° C. of from about 5 to about 7.5, the composition includes a surface-modification surface-substantive polymer.

19 Claims, No Drawings

AUTOMATIC DISHWASHING DETERGENT COMPOSITION

TECHNICAL FIELD

The present invention is in the field of automatic dishwashing. In particular it relates to a composition that is able to provide effective cleaning and shine by reducing filming and spotting that can be generated during automatic dishwashing.

BACKGROUND OF THE INVENTION

The aim of a dishwashing composition is twofold: to clean soiled items and to leave them shiny. Typically when water dries from surfaces water-marks, smears or spots are left behind. These water-marks may be due to the evaporation of water from the surface leaving behind deposits of minerals which were present as dissolved solids in the water, for example calcium, magnesium and sodium ions and salts thereof or may be deposits of water-carried soils, or even remnants from a cleaning product, for example soap scum. This problem is often exacerbated by some cleaning compositions which modify the surface during the cleaning process in such a way that after rinsing, water forms discrete droplets or beads on the surface instead of draining off. These droplets or beads dry to leave noticeable spots or marks known as water-marks Filming can also occur during automatic dishwashing. Filming and spotting can be particularly apparent on ceramic, steel, plastic, glass or painted surfaces. The problem is further exacerbated after the dishware is exposed multi-cycles, in some occasions the filming or spotting might not look bad when the dishware has been subjected to automatic dishwashing just once or a couple of times but it becomes worse after the dishware has been subjected to a large number of cycles.

The object of the present invention is to provide a dishwashing composition that leaves the washed items clean and shiny, after the dishware has been exposed to a single cycle and to a plurality of cycles.

SUMMARY OF THE INVENTION

According to a first aspect of the invention there is provided an automatic dishwashing composition that is able to provide effective cleaning and reduce filming and spotting that can be generated during automatic dishwashing.

For the purpose of this invention "dishware" encompasses tableware, cookware and any food-holding/handling items used for cooking and/or eating.

Typical automatic dishwashing products are formulated such that a 1% solution of the product has a pH of between 9 and 11.5 at 25° C. This is because in order to effectively clean the items found within the dishwasher and minimize the number of residues found in the machine filter, an automatic dishwashing product is formulated at high pH in order to effectively hydrate and swell soils, provide a pH range in which bleaches are effective (the hydroperoxide anion is a valuable bleaching species, either on its own or as a means to perhydrolyze a bleach activator such as TAED) and a pH in which triglyceride grease soils are effectively hydrolyzed. Such compositions are well optimized to provide cleaning and lack of film on the washes items but still the washed items can present spots that can connote lack of cleaning.

It has surprisingly been found that by formulating a neutral or acidic automatic dishwashing detergent composition comprising a specific surface-modification surface-substantive polymer, the composition provides good cleaning and good finishing (including filming and spotting reduction) under single cycle and multi-cycles conditions.

By neutral or acidic composition is herein understood a composition that in a 1% solution in distilled water has a pH of from 5 to 7.5, preferably from 5.5 to 7, more preferably from 5.5 to 6.6. The composition provides good cleaning and shine.

The detergent composition of the invention comprises a surface-modification surface-substantive polymer comprising in copolymerized form from:

i. 60% to 99% by weight of the cationic polymer of at least one monoethylenically unsaturated polyalkylene oxide monomer of the formula I (monomer (A))

I

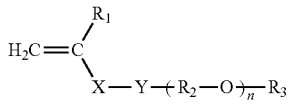

in which the variables have the following meanings:

X is —CH2- or —CO—, if Y is —O—;
X is —CO—, if Y is —NH—;
Y is —O— or —NH—;
R1 is hydrogen or methyl;
R2 are identical or different C2-C6-alkylene radicals;
R3 is H or C1-C4 alkyl;
n is an integer from 3 to 100, preferably from 15 to 60, ii. from 1 to 40% by weight of the cationic polymer of at least one quaternized nitrogen-containing monomer, selected from the group consisting of at least one of the monomers of the formula IIa to IId (monomer (B))

IIa

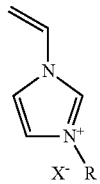

IIb

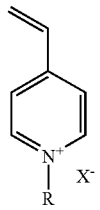

IIc

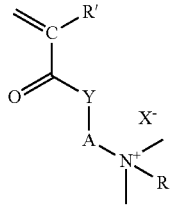

IId

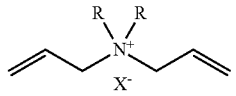

in which the variables have the following meanings:

R is C1-C4 alkyl or benzyl;

R' is hydrogen or methyl;

Y is —O— or —NH—;

A is C1-C6 alkylene;

X— is halide, C1-C4-alkyl sulfate, C1-C4-alkylsulfonate and C1-C4-alkyl carbonate.

iii. from 0 to 15% by weight of the cationic polymer of at least one anionic monoethylenically unsaturated monomer (monomer (C)), and iv. from 0 to 30% by weight of the cationic polymer of at least one other nonionic monoethylenically unsaturated monomer (monomer (D)), and the cationic polymer has a weight average molecular weight (Mw) from 2,000 to 500,000, preferably from 25,000 g/mol to 200,000 g/mol.

The copolymer of the invention is the result of the copolymerization of: monomer (A): a monoethylenically unsaturated polyalkylene oxide monomer and monomer (B): a quaternized nitrogen-containing monomer and optionally monomer (C): an anionic monoethylenically unsaturated monomer and monomer (D): a nonionic monoethylenically unsaturated monomer. The copolymer has a weight average molecular weight (Mw) from 100,000 g/mol to 500,000 g/mol, preferably from 105,000 g/mol to 450,000 g/mol, more preferably from 110,000 g/mol to 400,000 g/mol.

Preferably the weight ratio of monomer (A) to monomer (B) is greater than 2:1, more preferably greater than 3:1 and preferably less than 5:1 and for the case where the copolymer comprises a monomer (C), the weight ratio of monomer (B) to monomer (C) is also greater than 2:1 and more preferably greater than 2.5:1 and preferably less than 20:1. Copolymers having these ratios seem to impart the suraces washed the right surface modification to decrease the number of spots and filming and provide shiny surfaces.

Preferred copolymers for use herein are those comprising methylpolyethylene glycol (meth)acrylate as monomer (A). Also preferred copolymers for use herein are those comprising a salt of 3-methyl-1-vinylimidazolium as monomer (B). Especially preferred copolymers for use herein comprises methylpolyethylene glycol (meth)acrylate as monomer (A) and a salt of 3-methyl-1-vinylimidazolium as monomer (B). More preferably the copolymer comprises from 70 to 80% by weight of the copolymer of methylpolyethylene glycol (meth)acrylate and from 10 to 30% by weight of the copolymer of a salt of 3-methyl-1-vinylimidazolium. These copolymers have been found to reduce the number of spots and filming on washed surfaces leaving the surfaces shiny.

There are also preferred copolymers comprising methylpolyethylene glycol (meth)acrylate as monomer (A) and a salt of 3-methyl-1-vinylimidazolium as monomer (B) and the weight ratios indicated herein before.

Preferred copolymers are those in which R2 of formula I is ethylene and n is from 20 to 100, more preferably from 15 to 90 and especially from 20 to 60.

Preferably, the composition of the invention is "substantially builder-free". For the purpose of this invention a "substantially builder-free composition" is a composition comprising less than 10%, preferably less than 5%, more preferably less than 1% and especially less than 0.1% by weight of the composition of builder. Builders are cleaning actives widely used in automatic dishwashing detergents, in particular in alkaline compositions. Most, if not all, of the automatic dishwashing detergents available in the market are alkaline and comprise builders. Compounds that would act as builder under alkaline conditions would probably not be good builders under the low pH conditions of the composition of the invention. Builders can sequester calcium and other ions, from soils and from water greatly contributing to cleaning. The downside of using builders is that they can precipitate and give rise to filming and spotting on the washed items. The formulation approach used in the composition of the present invention overcomes the filming and spotting issues. The washed items, in particular, glass items are left clear and shiny.

The soils brought into the wash liquor during the automatic dishwashing process can greatly alter the pH of the wash liquor. In order to provide optimum cleaning the pH of the wash liquor should not vary too much. This is achieved with the composition of the present invention by the presence of a pH regulator system that helps to keep the pH of the wash liquor within a desired range.

The composition of the invention comprises a pH regulator system. The pH regulator system provides the right pH and maintains the pH of the wash liquor within a narrow range. By a "narrow range" is herein meant that the pH changes by less than 2 pH units, more preferably by less than 1 pH unit.

Preferably the pH regulator system comprises an organic acid and its salt, preferably a carboxylic acid more preferably a polycarboxylic acid and its salt. A specially preferred pH regulator system for use herein comprises citric acid and citrate.

Good cleaning and filming and spotting reduction can be obtained when the composition further comprises non-ionic surfactant in addition to the surface-modification surface-substantive polymer, especially when the non-ionic surfactant is selected from the group consisting of:

a) a non-ionic surfactant of formula RO(CH2CH2O)xH wherein where R is iso-C13H27 and x is 7;

b) a non-ionic surfactant of formula RO(CH2CH2O)x (CH2CH2CH2O)yH wherein where R is a C6-C14 alkyl and x and y are from 5 to 20; and c) mixtures thereof.

More especially when the non-ionic surfactant is a mixture of a) and b).

Preferably, the non-ionic surfactant and the surface-modification surface-substantive polymer are in a weight ratio of from about 1:1 to about 10:1, preferably from about 1:1 to about 4:1.

It has also been found that bleach presents in the composition of the invention provides a bleaching benefit much greater than expected. It has also been found that the bleaching occurs faster and at lower temperatures than using conventional alkaline detergents. Without being bound by theory, it is believed that the iron ions present into the wash liquor (brought by soils, such as tea, beef, etc., impurities in detergent components and/or water) act as catalyst for the bleach to generate bleaching radicals. This effect is most pronounced when an iron chelant is used and it is believed that this is the case because the iron chelant binds the iron to generate metal catalysts in situ that when combined with the bleach are able to drive excellent bleach cleaning.

The composition of the invention can comprise an iron chelant. Compositions comprising an iron chelant provide good cleaning of bleachable stains, even in the absence of bleach or with low level of bleach. Without being bound by theory, it is believed that the iron chelant removes heavy metals that form part of bleachable stains, thereby contributing to the loosening of the stain. The stain tends to detach itself from the soiled substrate. The cleaning can be further helped by the presence of a performance polymer, preferably a soil suspension polymer that would help with the suspension of the stain. Under the low pH conditions provided by the compositions of the invention, when the heavy metals are taken from the bleachable stain, the stain can become more particulate in nature and the polymer can help with suspension of the stain. Preferred iron chelants for use herein have been found to be disodium catecholdisulfonate and hydroxypyridine N-Oxides, in particular disodium catecholdisulfonate.

The composition of the invention preferably comprises an amylase and a protease, more preferably the amylase is a low temperature amylase. Preferably, the composition further comprises a soil suspension polymer. It seems that the amylase, the esterified alkyl alkoxylated surfactant, the non-ionic surfactant and the soil suspension polymer work in synergy to provide very good cleaning and shine. Without being bound by theory it is believed that the non-ionic surfactant and the soil suspension polymer keep the soil, especially greasy soils, suspended leaving the starchy part of soils exposed this facilitate the access of the amylase to the starch. Preferred soil suspension polymer for use herein is an alkoxylated polyalkyleneimine.

The cleaning provided by the composition of the invention is further improved when the composition comprises a crystal growth inhibitor, in particular HEDP. Preferably the composition further comprises a dispersant polymer, more preferably a carboxylated/sulfaonted polymer that further contributes to filming reduction. Preferably the composition further comprises a esterified alkyl alkoxylated surfactant that further contributes to spotting reduction.

Preferably the composition of the invention comprises a non-ionic surfactant, more preferably a mixture of:

a) a non-ionic surfactant of formula RO(CH2CH2O)xH wherein where R is iso-C13H27 and x is 7; and b) a non-ionic surfactant of formula RO(CH2CH2O)x (CH2CH2CH2O)yH wherein where R is a C6-C14 alkyl and x and y are from 5 to 20 alcohol alkoxylated surfactant.

It has been surprisingly found that automatic dishwashing detergents comprising a mixture of these two surfactants (a) and b)) provide better spotting reduction than compositions comprising any of the two surfactants on their own.

Preferred compositions further comprise proteases. In particular proteases selected from the group consisting of:

(i) a metalloprotease;

(ii) a cysteine protease;

(iii) a neutral serine protease;

(iv) an aspartate protease, and (v) mixtures thereof.

These proteases perform well in the low pH composition of the invention. Some of the proteases present in conventional alkaline detergents do not perform well at the pH of the composition of the invention. Also preferred are endoproteases, preferably those with an isoelectric point of from about 4 to about 9 and more preferably from about 4.5 to about 6.5. Compositions comprising proteases having these isoelectric points perform very well in the low pH compositions of the invention.

The compositions of the invention is so effective that only a low level needs to be used in the dishwasher to provide outstanding results thereby allowing for very compact compositions. The composition of the invention is preferably used in a weight per wash of from about 5 to about 25 grams, more preferably from about 7 to about 20 grams and especially from about 7 to about 15 grams.

According to the second aspect of the invention, there is provided a method of reducing filming and spotting on dishware in automatic dishwashing using the composition of the invention. The method provides very good results even under multi-cycles conditions. There is also provided the use of the composition of the invention to reduce filming and spotting on dishware, preferably under multi-cycle conditions, i.e, the dishware is subjected to more than two cycles, more preferably more than 10 and specially more than 20 cycles. The composition according to the first aspect of the invention applies mutatis mutandis to the second and third aspects.

DETAILED DESCRIPTION OF THE INVENTION

The present invention envisages a neutral or acidic automatic dishwashing detergent composition comprising a surface-modification surface-substantive polymer. The composition provides good cleaning and shine (reduced filming and spotting). The present invention also provides a method of reducing filming and spotting in automatic dishwashing and the use of the composition of the invention to reduce filming and spotting in automatic dishwashing Automatic Dishwashing Detergent Composition Surface-modification Surface-substantive Polymer The cleaning composition of the invention preferably comprises from about 0.01% to 10%, more preferably from 0.05% to 8%, especially from 0.1% to 5%, by weight of the cleaning composition, of the surface-modification surface-substantive polymer.

Without wishing to be bound by theory, it is believed that the surface-modification surface-substantive polymer works by facilitating efficient drainage of the wash liquor and/or rinsing water by forming rivulets. This helps prevent the generation of aqueous droplets which, upon drying, can result in deposition of residues on the dishware surface and consequent formation of visible spots or streaks. The surface-modification surface-substantive polymer has sufficient surface substantivity to remain on the surface of the dishware during the rinse cycles, thus providing the drainage action in the rinse phase even if the surface-modification surface-substantive polymer has been delivered into the main wash solution, together with the rest of the cleaning composition. This reduces or eliminates the need for a separate rinse aid product. The composition of the invention provides benefits on glass, ceramics, plastics and stainless steel dishware.

A preferred polymer comprises monomers selected from the group comprising monomers of formula (I) (Monomer A) and monomers of formula (IIa-IId) (Monomer B). The polymer comprises from 60 to 99%, preferably from 70 to 95% and especially from 80 to 90% by weight of at least one monoethylenically unsaturated polyalkylene oxide monomer of the formula (I) (monomer A)

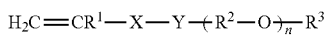

$$H_2C{=}CR^1{-}X{-}Y{-}(R^2{-}O)_n{-}R^3 \quad \text{I}$$

wherein Y of formula (I) is selected from —O— and —NH—; if Y of formula (I) is —O—, X of formula (I) is selected from —$CH_2$— or —CO—, if Y of formula (I) is —NH—, X of formula (I) is —CO—; $R^1$ of formula (I) is selected from hydrogen, methyl, and mixtures thereof; $R^2$ of formula (I) is independently selected from linear or branched $C_2$-$C_6$-alkylene radicals, which may be arranged blockwise or randomly; $R^3$ of formula (I) is selected from hydrogen, $C_1$-$C_4$-alkyl, and mixtures thereof; n of formula (I) is an integer from 5 to 100, preferably from 10 to 70 and more preferably from 20 to 60.

The polymer comprises from 1 to 40%, preferably from 2 to 30% and especially from 5 to 25% by weight of at least one quaternized nitrogen-containing monoethylenically unsaturated monomer of formula (IIa-IId) (monomer B).

IIa

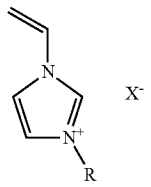

IIb

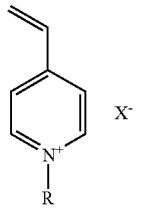

IIc

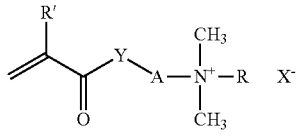

IId

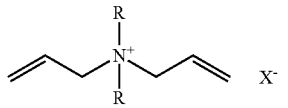

The monomers are selected such that the polymer has a weight average molecular weight ($M_w$) of from 20,000 to 500,000 g/mol, preferably from greater than 25,000 to 250,000 g/mol and especially from 30,000 to 200,000 g/mol.

The polymer preferably has a net positive charge when dissolved in an aqueous solution with a pH of 5 or above.

The polymer may further comprise monomers C and/or D. Monomer C may comprise from 0% to 15%, preferably from 0 to 10% and especially from 1 to 7% by weight of the polymer of an anionic monoethylenically unsaturated monomer.

Monomer D may comprise from 0% to 40%, preferably from 1 to 30% and especially from 5 to 20% by weight of the polymer of other non-ionic monoethylenically unsaturated monomers.

Preferred surface-modification surface-substantive polymers for use in the composition of the invention comprise, as polymerized Monomer A, monoethylenic ally unsaturated polyalkylene oxide monomers of formula (I) in which Y of formula (I) is —O—; X of formula (I) is —CO—; $R^1$ of formula (I) is hydrogen or methyl; $R^2$ of formula (I) is independently selected from linear or branched $C_2$-$C_4$-alkylene radicals arranged blockwise or randomly, preferably ethylene, 1,2- or 1,3-propylene or mixtures thereof, particularly preferably ethylene; $R^3$ of formula (I) is methyl; and n is an integer from 5 to 100.

Monomer A

A monomer A may be, for example:

(a) reaction products of (meth)acrylic acid with polyalkylene glycols which are not terminally capped, terminally capped at one end by alkyl radicals; and (b) alkenyl ethers of polyalkylene glycols which are not terminally capped or terminally capped at one end by alkyl radicals.

Preferred monomer A is the (meth)acrylates and the allyl ethers, where the acrylates and primarily the methacrylates are particularly preferred. Particularly suitable examples of the monomer A are:

(a) methylpolyethylene glycol (meth)acrylate and (meth) acrylamide, methylpolypropylene glycol (meth)acrylate and (meth)acrylamide, methylpolybutylene glycol (meth)acrylate and (meth)acrylamide, methylpoly(propylene oxide-co-ethylene oxide) (meth)acrylate and (meth)acrylamide, ethylpolyethylene glycol (meth) acrylate and (meth)acrylamide, ethylpolypropylene glycol (meth)acrylate and (meth)acrylamide, ethylpolybutylene glycol (meth)acrylate and (meth)acrylamide and ethylpoly(propylene oxide-co-ethylene oxide) (meth)acrylate and (meth)acrylamide, each with 5 to 100, preferably 10 to 70 and particularly preferably 20 to 60, alkylene oxide units, where methylpolyethylene glycol acrylate is preferred and methylpolyethylene glycol methacrylate is particularly preferred;

(b) ethylene glycol allyl ethers and methylethylene glycol allyl ethers, propylene glycol allyl ethers and methylpropylene glycol allyl ethers each with 5 to 100, preferably 10 to 70 and particularly preferably 20 to 60, alkylene oxide units.

The proportion of Monomer A in the polymer is 60% to 99% by weight, preferably 70% to 95%, more preferably from 75% to 90% by weight of the polymer.

Monomer B

A monomer B that is particularly suitable includes the quaternization products of 1-vinylimidazoles, of vinylpyridines, of (meth)acrylic esters with amino alcohols, in particular N,N-di-$C_1$-$C_4$-alkylamino-$C_2$-$C_6$-alcohols, of amino-containing (meth)acrylamides, in particular N,N-di-$C_1$-$C_4$-alkyl-amino-$C_2$-$C_6$-alkylamides of (meth)acrylic acid, and of diallylalkylamines, in particular diallyl-$C_1$-$C_4$-alkylamines.

Suitable monomers B have the formula IIa to IId:

IIa

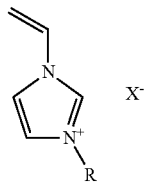

IIb

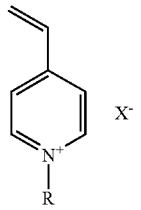

IIc

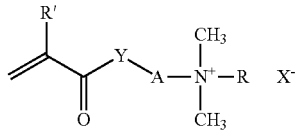

-continued

IId

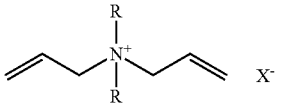

wherein R of formula IIa to IId is selected from $C_1$-$C_4$-alkyl or benzyl, preferably methyl, ethyl or benzyl; R' of formula IIc is selected from hydrogen or methyl; Y of formula IIc is selected from —O— or —NH—; A of formula IIc is selected from $C_1$-$C_6$-alkylene, preferably straight-chain or branched $C_2$-$C_4$-alkylene, in particular 1,2-ethylene, 1,3- and 1,2-propylene or 1,4-butylene; X— of formula IIa to IId is selected from halide, such as iodide and preferably chloride or bromide, $C_1$-$C_4$-alkyl sulfate, preferably methyl sulfate or ethyl sulfate, $C_1$-$C_4$-alkylsulfonate, preferably methylsulfonate or ethylsulfonate, $C_1$-$C_4$-alkyl carbonate; and mixtures thereof.

Specific examples of preferred monomer B that may be utilized are:

(a) 3-methyl-1-vinylimidazolium chloride, 3-methyl-1-vinylimidazolium methyl sulfate, 3-ethyl-1-vinylimidazolium ethyl sulfate, 3-ethyl-1-vinylimidazolium chloride and 3-benzyl-1-vinylimidazolium chloride;

(b) 1-methyl-4-vinylpyridinium chloride, 1-methyl-4-vinylpyridinium methyl sulfate and 1-benzyl-4-vinylpyridinium chloride;

(c) 3-methacrylamido-N,N,N-trimethylpropan-1-aminium chloride, 3-acryl-N,N,N-trimethylpropan-1-aminium chloride, 3-acryl-N,N,N-trimethylpropan-1-aminium methylsulfate, 3-methacryl-N,N,N-trimethylpropan-1-aminium chloride, 3-methacryl-N,N,N-trimethylpropan-1-aminium methylsulfate, 2-acrylamido-N,N,N-trimethylethan-1-aminium chloride, 2-acryl-N,N,N-trimethylethan-1-aminium chloride, 2-acryl-N,N,N-trimethylethan-1-aminium methyl sulfate, 2-methacryl-N,N,N-trimethylethan-1-aminium chloride, 2-methacryl-N,N,N-trimethylethan-1-aminium methyl sulfate, 2-acryl-N,N-dimethyl-N-ethylethan-1-aminium ethylsulfate, 2-methacryl-N,N-dimethyl-N-ethylethan-1-aminium ethylsulfate, and (d) dimethyldiallylammonium chloride and diethyldiallylammonium chloride.

A preferred monomer B is selected from 3-methyl-1-vinylimidazolium chloride, 3-methyl-1-vinylimidazolium methyl sulfate, 3-methacryl-N,N,N-trimethylpropan-1-aminium chloride, 2-methacryl-N,N,N-trimethylethan-1-aminium chloride, 2-methacryl-N,N-dimethyl-N-ethylethan-1-aminium ethylsulfate, and dimethyldiallylammonium chloride.

The polymer comprises 1% to 40% by weight, preferably 2% to 30%, and especially preferable from 5 to 20% by weight of the polymer, of Monomer B. The weight ratio of Monomer A to Monomer B is preferably equal to or greater than 2:1, preferably from 3:1 to 5:1.

Monomer C

As optional components of the polymer of the present invention, monomers C and D may also be utilized. Monomer C is selected from anionic monoethylenically unsaturated monomers. Suitable monomer C may be selected from:

(a) α,β-unsaturated monocarboxylic acids which preferably have 3 to 6 carbon atoms, such as acrylic acid, methacrylic acid, 2-methylenebutanoic acid, crotonic acid and vinylacetic acid, preference being given to acrylic acid and methacrylic acid;

(b) unsaturated dicarboxylic acids, which preferably have 4 to 6 carbon atoms, such as itaconic acid and maleic acid, anhydrides thereof, such as maleic anhydride;

(c) ethylenically unsaturated sulfonic acids, such as vinylsulfonic acid, acrylamido-propanesulfonic acid, methallylsulfonic acid, methacrylsulfonic acid, m- and p-styrenesulfonic acid, (meth)acrylamidomethanesulfonic acid, (meth)acrylamidoethanesulfonic acid, (meth)acrylamidopropanesulfonic acid, 2-(meth) acrylamido-2-methylpropanesulfonic acid, 2-acrylamido-2-butanesulfonic acid, 3-methacrylamido-2-hydroxypropanesulfonic acid, methanesulfonic acid acrylate, ethanesulfonic acid acrylate, propanesulfonic acid acrylate, allyloxybenzenesulfonic acid, methallyloxybenzenesulfonic acid and 1-allyloxy-2-hydroxypropanesulfonic acid; and (d) ethylenically unsaturated phosphonic acids, such as vinylphosphonic acid and m- and p-styrenephosphonic acid.

The anionic Monomer C can be present in the form of water soluble free acids or in water-soluble salt form, especially in the form of alkali metal and ammonium, in particular alkylammonium, salts, and preferred salts being the sodium salts.

A preferred Monomer C may be selected from acrylic acid, methacrylic acid, maleic acid, vinylsulfonic acid, 2-(meth)acrylamido-2-methylpropanesulfonic acid and vinylphosphonic acid, particular preference being given to acrylic acid, methacrylic acid and 2-acrylamido-2-methylpropanesulfonic acid.

The proportion of monomer C in the polymer can be up to 15% by weight, preferably from 1% to 5% by weight of the polymer.

If monomer C is present in the polymer, then, the molar ratio of monomer B to monomer C is greater than 1. The weight ratio of Monomer A to monomer C is preferably equal to or greater than 4:1, more preferably equal to or greater than 5:1. Additionally, the weight ratio of monomer B to monomer C is equal or greater than 2:1, and even more preferable from 2.5:1 to less than 20:1. Polymers having these ratios may impart effective levels of surface modification to reduce or decrease spotting and provide shiny surfaces.

Monomer D

As an optional component of the polymer, monomer D may also be utilized. Monomer D is selected from nonionic monoethylenically unsaturated monomers selected from:

(a) esters of monoethylenically unsaturated $C_3$-$C_6$-carboxylic acids, especially acrylic acid and methacrylic acid, with monohydric $C_1$-$C_{22}$-alcohols, in particular $C_1$-$C_{16}$-alcohols; and hydroxyalkyl esters of monoethylenically unsaturated $C_3$-$C_6$-carboyxlic acids, especially acrylic acid and methacrylic acid, with divalent $C_2$-$C_4$-alcohols, such as methyl (meth)acrylate, ethyl (meth)acrylate, n-butyl (meth)acrylate, sec-butyl (meth)acrylate, tert-butyl (meth)acrylate, ethylhexyl (meth)acrylate, decyl (meth)acrylate, lauryl (meth) acrylate, isobornyl (meth)acrylate, cetyl (meth)acrylate, palmityl (meth)acrylate and stearyl (meth)acrylate, hydroxyethyl (meth)acrylate, hydroxypropyl (meth)acrylate and hydroxybutyl (meth)acrylate;

(b) amides of monoethylenically unsaturated $C_3$-$C_6$-carboxylic acids, especially acrylic acid and methacrylic acid, with $C_1$-$C_{12}$-alkylamines and di($C_1$-$C_4$-alkyl) amines, such as N-methyl(meth)acrylamide, N,N-dimethyl(meth)acrylamide, N-ethyl(meth)acrylamide, N-propyl(meth)acrylamide, N-tert-butyl(meth)acrylamide, N-tert-octyl(meth)acrylamide and N-undecyl (meth)acrylamide, and (meth)acrylamide;

(c) vinyl esters of saturated $C_2$-$C_{30}$-carboxylic acids, in particular $C_2$-$C_{14}$-carboxylic acids, such as vinyl acetate, vinyl propionate, vinyl butyrate, vinyl 2-ethylhexanoate and vinyl laurate;

(d) vinyl $C_1$-$C_{30}$-alkyl ethers, in particular vinyl $C_1$-$C_{18}$-alkyl ethers, such as vinyl methyl ether, vinyl ethyl ether, vinyl n-propyl ether, vinyl isopropyl ether, vinyl n-butyl ether, vinyl isobutyl ether, vinyl 2-ethylhexyl ether and vinyl octadecyl ether;

(e) N-vinylamides and N-vinyllactams, such as N-vinylformamide, N-vinyl-N-methyl-formamide, N-vinylacetamide, N-vinyl-N-methylacetamide, N-vinylimidazol, N-vinylpyrrolidone, N-vinylpiperidone and N-vinylcaprolactam;

(f) aliphatic and aromatic olefins, such as ethylene, propylene, $C_4$-$C_{24}$-α-olefins, in particular $C_4$-$C_{16}$-α-olefins, e.g. butylene, isobutylene, diisobutene, styrene and α-methylstyrene, and also diolefins with an active double bond, e.g. butadiene;

(g) unsaturated nitriles, such as acrylonitrile and methacrylonitrile.

A preferred monomer D is selected from methyl (meth) acrylate, ethyl (meth)acrylate, (meth)acrylamide, vinyl acetate, vinyl propionate, vinyl methyl ether, N-vinylformamide, N-vinylpyrrolidone, N-vinylimidazole and N-vinylcaprolactam. N-vinylimidazol is particularly preferred.

If the monomer D is present in the polymer, then the proportion of monomer D may be up to 40%, preferably from 1% to 30%, more preferably from 5% to 20% by weight of the polymer.

Preferred polymers of the present invention include:

Polymer 1

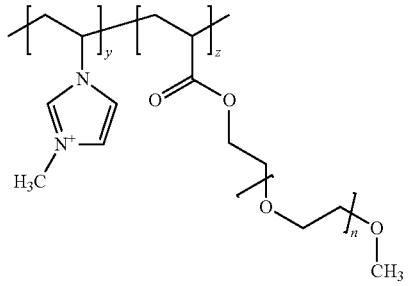

Polymer 2

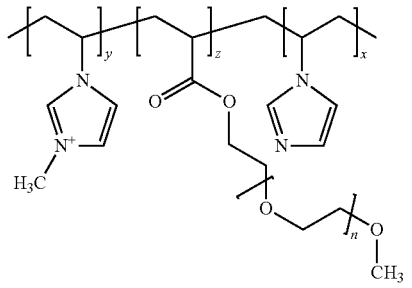

wherein indices y and z are such that the monomer ratio (z:y) is from 3:1 to 20:1 and the indices x and z are such that the monomer ratio (z:x) is from 1.5:1 to 20:1, and the polymer has a weight average molecular weight of from 20,000 to 500,000 g/mol, preferably from greater than 25,000 to 250,000 g/mol and especially from 30,000 to 200,000 g/mol.

These polymers can be prepared by free-radical polymerization of the Monomers A and B and if desired C and/or D. The free-radical polymerization of the monomers can be carried out in accordance with all known methods, preference being given to the processes of solution polymerization and of emulsion polymerization. Suitable polymerization initiators are compounds which decompose thermally or photochemically (photoinitiators) to form free radicals, such as benzophenone, acetophenone, benzoin ether, benzyl dialkyl ketones and derivatives thereof.

The polymerization initiators are used according to the requirements of the material to be polymerized, usually in amounts of from 0.01% to 15%, preferably 0.5% to 5% by weight based on the monomers to be polymerized, and can be used individually or in combination with one another.

Instead of a quaternized Monomer B, it is also possible to use the corresponding tertiary amines. In this case, the quaternization is carried out after the polymerization by reacting the resulting copolymer with alkylating agents, such as alkyl halides, dialkyl sulfates and dialkyl carbonates, or benzyl halides, such as benzyl chloride. Examples of suitable alkylating agents which may be mentioned are, methyl chloride, bromide and iodide, ethyl chloride and bromide, dimethyl sulfate, diethyl sulfate, dimethyl carbonate and diethyl carbonate.

The anionic monomer C can be used in the polymerization either in the form of the free acids or in a form partially or completely neutralized with bases. Specific examples that may be listed are: sodium hydroxide solution, potassium hydroxide solution, sodium carbonate, sodium hydrogen carbonate, ethanolamine, diethanolamine and triethanolamine.

To limit the molar masses of the polymers, customary regulators can be added during the polymerization, e.g. mercapto compounds, such as mercaptoethanol, thioglycolic acid and sodium disulfite. Suitable amounts of regulator are 0.1% to 5% by weight based on the monomers to be polymerized.

Other preferred polymers may comprise combinations of Monomers B, C and D, where the molar percent of monomer B is higher than the molar content of monomer C, rendering a net positive charge to the copolymer.

Preferred surface-modification surface-substantive polymer for use herein are those comprising methylpolyethylene glycol (meth)acrylate as monomer A. Also preferred polymers for use herein are those comprising a salt of 3-methyl-1-vinylimidazolium as monomer B. Especially preferred polymers for use herein comprises methylpolyethylene glycol (meth)acrylate as monomer A and a salt of 3-methyl-1-vinylimidazolium as monomer B. More preferably the polymer comprises from 70 to 80% by weight of the polymer of methylpolyethylene glycol (meth)acrylate and from 10 to 30% by weight of the polymer of a salt of 3-methyl-1-vinylimidazolium. These polymers have been found to reduce the number of spots and filming on washed surfaces leaving the surfaces shiny.

There are also preferred surface-modification surface-substantive polymers comprising methylpolyethylene glycol (meth)acrylate as monomer A, a salt of 3-methyl-1-vinylimidazolium as monomer B and N-vinylimidazole as monomer D.

Preferred copolymers are those in which the ethylene glycol unit is repeated from 3 to 100, more preferably from 10 to 80 and especially from 15 to 50.

Esterified Alkyl Alkoxylated Surfactant

The detergent composition of the invention preferably comprises an esterified alkyl alkoxylated of general formula (I)

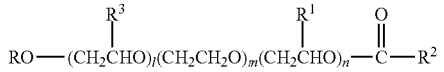

wherein

R is a branched or unbranched alkyl radical having 8 to 16 carbon atoms;

R3, R1 independently of one another, are hydrogen or a branched or unbranched alkyl radical having 1 to 5 carbon atoms;

R2 is an unbranched alkyl radical having 5 to 17 carbon atoms;

l, n independently of one another, are a number from 1 to 5 and m is a number from 13 to 35;

Preferably, the radical R is a branched alkyl radical having 9 to 16, more preferably having 10 to 13, carbon atoms. The degree of branching is preferably 1-3. For the purposes of the present invention, the term "degree of branching" is understood as meaning the number of methyl groups reduced by 1.

Further preferably, Ra, R1 independently of one another, are hydrogen, methyl and ethyl. If R3, R1 occur more frequently, then each can be chosen independently of a further R3 or R1. Thus Ra, R1 can occur blockwise or in random distribution.

R2 is preferably a branched or unbranched alkyl radical having 5 to 13 carbon atoms.

Preferably n=1, 1=5 and m is preferably a number from 13 to 34, more preferably 13 to 33, even more preferably 13 to 30, most preferably 17 to 27.

Further preferably, the average molecular weight is in a range from 950 to 2300 g/mol. Particularly preferably, the average molecular weight is in a range from 1200 to 1900 g/mol.

The esterified alkyl alkoxylated surfactant of the invention is a low foaming surfactant. The esterified surfactant is stable in an alkaline environment. Preferably the esterified surfactant has a melting point above 25° C., more preferably above 35° C.

The esterified surfactant of the invention can be synthesized as described in US2008/0167215, paragraphs [0036] to [0042], herein included by reference.

The composition of the invention has a neutral or acid pH. In addition to good cleaning and shine in automatic-dishwashing, this pH is quite gentle on the washed items, it is not as aggressive as commonly used alkaline compositions and therefore keep washed items such as glasses, patterned ware, etc looking new for longer.

The composition of the invention can be in any physical form including solid, liquid and gel form. The composition of the invention is very well suited to be presented in unit-dose form, in particular in the form of a multi-compartment pack, more in particular a multi-compartment pack comprising compartments with compositions in different physical forms, for example a compartment comprising a composition in solid form and another compartment comprising a composition in liquid form. Due to the efficacy of the composition, the packs can be compact.

pH Regulator System

The benefits provided by the composition of the invention are linked to the low pH of the wash liquor. It is not sufficient to provide a composition presenting a low pH when dissolved in deionised water what is important is that the low pH of the composition is maintained during the duration of the wash.

In the process of dishwashing, the water and the different ions coming from the soils can destabilise the pH of the composition. In order to maintain the composition at low pH a pH regulator system capable of maintaining the low pH during the wash is needed. The pH regulator system provides the right pH and it has buffering capacity to maintain this pH. A pH regulator system can be created either by using a mixture of an acid and its anion, such as a citrate salt and citric acid, or by using a mixture of the acid form (citric acid) with a source of alkalinity (such as a hydroxide, bicarbonate or carbonate salt) or by using the anion (sodium citrate) with a source of acidity (such as sodium bisulphate). Suitable pH regulator systems comprise mixtures of organic acids, preferably polycarboxylic acids and their salts, more preferably citric acid and citrate.

Preferably the composition of the invention comprises from about 1% to about 60%, more preferably from about 10% to about 40% by weight of the composition of a pH regulator system, preferably selected from citric acid, citrate and mixtures thereof.

Builder

Preferably, the composition of the invention is substantially builder free, i.e. comprises less than about 10%, preferably less than about 5%, more preferably less than about 1% and especially less than about 0.1% of builder by weight of the composition. Builders are materials that sequester hardness ions, particularly calcium and/or magnesium. Strong calcium builders are species that are particularly effective at binding calcium and exhibit strong calcium binding constants, particularly at high pHs.

For the purposes of this patent a "builder" is a strong calcium builder. A strong calcium builder can consist of a builder that when present at 0.5 mM in a solution containing 0.05 mM of Fe(III) and 2.5 mM of Ca(II) will selectively bind the calcium ahead of the iron at one or more of pHs 6.5 or 8 or 10.5. Specifically, the builder when present at 0.5 mM in a solution containing 0.05 mM of Fe(III) and 2.5 mM of Ca(II) will bind less than 50%, preferably less than 25%, more preferably less than 15%, more preferably less than 10%, more preferably less than 5%, more preferably less than 2% and specially less than 1% of the Fe(III) at one or preferably more of pHs 6.5 or 8 as measured at 25° C. The builder will also preferably bind at least 0.25 mM of the calcium, preferably at least 0.3 mM, preferably at least 0.4 mM, preferably at least 0.45 mM, preferably at least 0.49 mM of calcium at one or more of pHs 6.5 or 8 or 10.5 as measured at 25° C.

The most preferred strong calcium builders are those that will bind calcium with a molar ratio (builder:calcium) of less than 2.5:1, preferably less than 2:1, preferably less than 1.5:1 and most preferably as close as possible to 1:1, when equal quantities of calcium and builder are mixed at a concentration of 0.5 mM at one or more of pHs 6.5 or 8 or 10.5 as measured at 25° C. Examples of strong calcium builders include phosphate salts such as sodium tripolyphosphate, amino acid-based builders such as amino acid based compounds, in particular MGDA (methyl-glycine-diacetic acid), and salts and derivatives thereof, GLDA (glutamic-N,N-diacetic acid) and salts and derivatives thereof, IDS (iminodisuccinic acid) and salts and derivatives thereof, carboxy methyl inulin and salts and derivatives thereof and mixtures thereof.

Other builders include amino acid based compound or a succinate based compound. Other suitable builders are described in U.S. Pat. No. 6,426,229. In one aspect, suitable builders include; for example, aspartic acid-N-monoacetic acid (ASMA), aspartic acid-, -diacetic acid (ASDA), aspartic acid-N-monopropionic acid (ASMP), iminodisuccinic acid (IDA), N-(2-sulfomethyl) aspartic acid (SMAS), N-(2-sulfoethyl) aspartic acid (SEAS), N-(2-sulfomethyl) glutamic acid (SMGL), N-(2-sulfoethyl) glutamic acid (SEGL), N-methyliminodiacetic acid (MID A), alpha-alanine-N,N-diacetic acid (alpha-ALDA), serine-, -diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N, N-diacetic acid (SLDA), taurine-N, N-diacetic acid (TUDA) and sulfomethyl-N,N-diacetic acid (SMDA) and alkali metal salts or ammonium salts thereof.

Polycarboxylic acids and their salts do not act as builders at the pH of the present invention and therefore are not to be considered as builder within the meaning of the invention. Polycarboxylic acids and their salts are considered a pH regulator system within the meaning of the invention.

Iron Chelant

The composition of the invention preferably comprises an iron chelant at a level of from about 0.1% to about 5%, preferably from about 0.2% to about 2%, more preferably from about 0.4% to about 1% by weight of the composition.

As commonly understood in the detergent field, chelation herein means the binding or complexation of a bi- or multi-dentate ligand. These ligands, which are often organic compounds, are called chelants, chelators, chelating agents, and/or sequestering agent. Chelating agents form multiple bonds with a single metal ion. Chelants form soluble, complex molecules with certain metal ions, inactivating the ions so that they cannot normally react with other elements or ions to produce precipitates or scale. The ligand forms a chelate complex with the substrate. The term is reserved for complexes in which the metal ion is bound to two or more atoms of the chelant.

The composition of the present invention is preferably substantially free of builders and preferably comprises an iron chelant. An iron chelant has a strong affinity (and high binding constant) for Fe(III).

It is to be understood that chelants are to be distinguished from builders. For example, chelants are exclusively organic and can bind to metals through their N,P,O coordination sites or mixtures thereof while builders can be organic or inorganic and, when organic, generally bind to metals through their O coordination sites. Moreover, the chelants typically bind to transition metals much more strongly than to calcium and magnesium; that is to say, the ratio of their transition metal binding constants to their calcium/magnesium binding constants is very high. By contrast, builders herein exhibit much less selectivity for transition metal binding, the above-defined ratio being generally lower.

The chelant in the composition of the invention is a selective strong iron chelant that will preferentially bind with iron (III) versus calcium in a typical wash environment where calcium will be present in excess versus the iron, by a ratio of at least 10:1, preferably greater than 20:1. The iron chelant when present at 0.5 mM in a solution containing 0.05 mM of Fe(III) and 2.5 mM of Ca(II) will fully bind at least 50%, preferably at least 75%, more preferably at least 85%, more preferably at least 90%, more preferably at least 95%, more preferably at least 98% and specially at least 99% of the Fe(III) at one or preferably more of pHs 6.5 or 8 as measured at 25° C. The amount of Fe(III) and Ca(II) bound by a builder or chelant is determined as explained herein below Method for Determining Competitive Binding To determine the selective binding of a specific ligand to specific metal ions, such as iron(III) and calcium (II), the binding constants of the metal ion-ligand complex are obtained via reference tables if available, otherwise they are determined experimentally. A speciation modeling simulation can then be performed to quantitatively determine what metal ion-ligand complex will result under a specific set of conditions.

As used herein, the term "binding constant" is a measurement of the equilibrium state of binding, such as binding between a metal ion and a ligand to form a complex. The binding constant $K_{bc}$ (25° C. and an ionic strength (I) of 0.1 mol/L) is calculated using the following equation:

$$K_{bc}=[ML_x]/([M][L]^x)$$

where [L] is the concentration of ligand in mol/L, x is the number of ligands that bond to the metal, [M] is the concentration of metal ion in mol/L, and $[ML_x]$ is the concentration of the metal/ligand complex in mol/L.

Specific values of binding constants are obtained from the public database of the National Institute of Standards and Technology ("NIST"), R. M. Smith, and A. E. Martell, NIST Standard Reference Database 46, NIST Critically Selected Stability Constants of Metal Complexes: Version 8.0, May 2004, U.S. Department of Commerce, Technology Administration, NIST, Standard Reference Data Program, Gaithersburg, Md. If the binding constants for a specific ligand are not available in the database then they are measured experimentally.

Once the appropriate binding constants have been obtained, a speciation modeling simulation can be performed to quantitatively determine what metal ion-ligand complex will result under a specific set of conditions including ligand concentrations, metal ion concentrations, pH, temperature and ionic strength. For simulation purposes, NIST values at 25° C. and an ionic strength (I) of 0.1 mol/L with sodium as the background electrolyte are used. If no value is listed in NIST the value is measured experimentally. PHREEQC from the US Geological Survey, http://wwwbr-r.cr.usgs.gov/projects/GWC_coupled/phreeqc/. PHREEQC is used for speciation modeling simulation.

Iron chelants include those selected from siderophores, catechols, enterobactin, hydroxamates and hydroxypyridinones or hydroxypyridine N-Oxides. Preferred chelants include anionic catechols, particularly catechol sulphonates, hydroxamates and hydroxypyridine N-Oxides. Preferred strong chelants include hydroxypridine N-Oxide (HPNO), Octopirox, and/or Tiron (disodium 4,5-dihydroxy-1,3-benzenedisulfonate), with Tiron, HPNO and mixtures thereof as the most preferred for use in the composition of the invention. HPNO within the context of this invention can be substituted or unsubstituted. Numerous potential and actual resonance structures and tautomers can exist. It is to be understood that a particular structure includes all of the reasonable resonance structures and tautomers.

Bleach

The composition of the invention preferably comprises from 1% to 40% by weight of the composition of bleach, more preferably from 5 to 15% by weight of the composition of bleach. Socium percarbonate is the preferred bleach for use herein.

Inorganic and organic bleaches are suitable for use herein. Inorganic bleaches include perhydrate salts such as perborate, percarbonate, perphosphate, persulfate and persilicate salts. The inorganic perhydrate salts are normally the alkali metal salts. The inorganic perhydrate salt may be included as the crystalline solid without additional protection. Alternatively, the salt can be coated. Suitable coatings include sodium sulphate, sodium carbonate, sodium silicate and mixtures thereof. Said coatings can be applied as a mixture applied to the surface or sequentially in layers.

Alkali metal percarbonates, particularly sodium percarbonate is the preferred bleach for use herein. The percarbonate is most preferably incorporated into the products in a coated form which provides in-product stability.

Potassium peroxymonopersulfate is another inorganic perhydrate salt of utility herein.

Typical organic bleaches are organic peroxyacids, especially diperoxydodecanedioc acid, diperoxytetradecanedioc acid, and diperoxyhexadecanedioc acid. Mono- and diperazelaic acid, mono- and diperbrassylic acid are also suitable herein. Diacyl and Tetraacylperoxides, for instance dibenzoyl peroxide and dilauroyl peroxide, are other organic peroxides that can be used in the context of this invention.

Further typical organic bleaches include the peroxyacids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid[phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi(6-aminopercaproic acid).

Preferably, the level of bleach in the composition of the invention is from about 0 to about 10%, more preferably from about 0.1 to about 5%, even more preferably from about 0.5 to about 3% by weight of the composition Crystal Growth Inhibitor Crystal growth inhibitors are materials that can bind to calcium carbonate crystals and prevent further growth of species such as aragonite and calcite.

Examples of effective crystal growth inhibitors include phosphonates, polyphosphonates, inulin derivatives and cyclic polycarboxylates.

Suitable crystal growth inhibitors may be selected from the group comprising HEDP (1-hydroxyethylidene 1,1-diphosphonic acid), carboxymethylinulin (CMI), tricarballylic acid and cyclic carboxylates. For the purposes of this invention the term carboxylate covers both the anionic form and the protonated carboxylic acid form.

Cyclic carboxylates contain at least two, preferably three or preferably at least four carboxylate groups and the cyclic structure is based on either a mono- or bi-cyclic alkane or a heterocycle. Suitable cyclic structures include cyclopropane, cyclobutane, cyclohexane or cyclopentane or cycloheptane, bicyclo-heptane or bicyclo-octane and/or tetrahydrofuran. One preferred crystal growth inhibitor is cyclopentane tetracarboxylate.

Cyclic carboxylates having at least 75%, preferably 100% of the carboxylate groups on the same side, or in the "cis" position of the 3D-structure of the cycle are preferred for use herein. It is preferred that the two carboxylate groups, which are on the same side of the cycle are in directly neighbouring or "ortho" positions Preferred crystal growth inhibitors include HEDP, tricarballylic acid, tetrahydrofurantetracarboxylic acid (THFTCA) and cyclopentanetetracarboxylic acid (CPTCA). The THFTCA is preferably in the 2c,3t,4t,5c-configuration, and the CPTCA in the cis,cis,cis,cis-configuration.

The crystal growth inhibitors are present preferably in a quantity from about 0.01 to about 10%, particularly from about 0.02 to about 5% and in particular from 0.05 to 3% by weight of the composition.

Performance Polymer

In addition to the surface-modification surface-substantive polymer, the composition of the invention preferably comprises from 0.1% to about 5%, preferably from about 0.2% to about 3% by weight of the composition of a performance polymer. Suitable polymers include soil suspension polymers, preferably alkoxylated polyalkyleneimines, dispersant polymers, preferably carboxylated/sulfonated polymers, and mixtures thereof The performance polymers may be included to provide benefits in one or more of the areas of spotting and filming, dispersancy, cleaning and bleachable stain cleaning. A preferred performance polymer for use herein, in terms of cleaning of bleachable stains enhancing is an alkoxylated polyalkyleneimine.

Alkoxylated Polyalkyleneimine

The alkoxylated polyalkyleneimine has a polyalkyleneimine backbone and alkoxy chains. Preferably the polyalkyleneimine is polyethyleneimine Preferably, the alkoxylated polyalkyleneimine is not quaternized.

In a preferred alkoxylated polyalkyleneimine for use in the composition of the invention:

i) the polyalkyleneimine backbone represents from 0.5% to 40%, preferably from 1% to 30% and especially from 2% to 20% by weight of the alkoxylated polyalkyleneimine; and ii) the alkoxy chains represent from 60% to 99%, preferably from 50% to about 95%, more preferably from 60% to 90% by weight of the alkoxylated polyalkyleneimine.

Preferably, the alkoxy chains have an average of from about 1 to about 50, more preferably from about 2 to about 40, more preferably from about 3 to about 30 and especially from about 3 to about 20 and even more especially from about 4 to about 15 alkoxy units preferably ethoxy units. In other suitable polyalkyleneimine for use herein, the alkoxy chains have an average of from about 0 to 30, more preferably from about 1 to about 12, especially from about 1 to about 10 and even more especially from about 1 to about 8 propoxy units. Especially preferred are alkoxylated polyethyleneimines wherein the alkoxy chains comprise a combination of ethoxy and propoxy chains, in particular polyethyleneimines comprising chains of from 4 to 20 ethoxy units and from 0 to 6 propoxy units.

Preferably, the alkoxylated polyalkyleneimine is obtained from alkoxylation wherein the starting polyalkyleneimine has a weight-average molecular weight of from about 100 to about 60,000, preferably from about 200 to about 40,000, more preferably from about 300 to about 10,000 g/mol. A preferred example is 600 g/mol polyethyleneimine core ethoxylated to 20 EO groups per NH and is available from BASF.

Other suitable polyalkyleneimines for use herein includes compounds having the following general structure: bis $((C_2H_5O)(C_2H_4O)_n)(CH_3)—N^+—C_xH_{2x}—N^+—(CH_3)$-bis $((C_2H_5O)(C_2H_4O)_n)$, wherein n=from 20 to 30, and x=from 3 to 8, or sulphated or sulphonated variants thereof.

Carboxylated/Sulfonated Polymers

Suitable carboxylated/sulfonated polymers described herein may have a weight average molecular weight of less than or equal to about 100,000 Da, preferably less than or equal to about 75,000 Da, more preferably less than or equal to about 50,000 Da, more preferably from about 3,000 Da to about 50,000, and specially from about 5,000 Da to about 45,000 Da.

Preferred carboxylic acid monomers include one or more of the following: acrylic acid, maleic acid, itaconic acid, methacrylic acid, or ethoxylate esters of acrylic acids, acrylic and methacrylic acids being more preferred. Preferred sulfonated monomers include one or more of the following: sodium (meth) allyl sulfonate, vinyl sulfonate, sodium phenyl (meth) allyl ether sulfonate, or 2-acrylamidomethyl propane sulfonic acid. Preferred non-ionic monomers include one or more of the following: methyl (meth) acrylate, ethyl (meth) acrylate, t-butyl (meth) acrylate, methyl (meth) acrylamide, ethyl (meth) acrylamide, t-butyl (meth) acrylamide, styrene, or α-methyl styrene.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

Preferred commercial available polymers include: Alcosperse 240, Aquatreat AR 540 and Aquatreat MPS supplied by Alco Chemical; Acumer 3100, Acumer 2000, Acusol 587G and Acusol 588G supplied by Rohm & Haas; Goodrich K-798, K-775 and K-797 supplied by BF Goodrich; and ACP 1042 supplied by ISP technologies Inc. Particularly preferred polymers are Acusol 587G and Acusol 588G supplied by Rohm & Haas, Versaflex Si™ (sold by Alco Chemical, Tennessee, USA) and those described in U.S. Pat. No. 5,308,532 and in WO 2005/090541. Suitable styrene co-polymers may be selected from the group comprising, styrene co-polymers with acrylic acid and optionally sulphonate groups, having average molecular weights in the range 1,000-50,000, or even 2,000-10,000 such as those supplied by Alco Chemical Tennessee, USA, under the tradenames Alcosperse® 729 and 747.

Non-ionic Surfactants

Suitable for use herein are non-ionic surfactants, they can acts as anti-redeposition agents. Preferably, the composition comprises a non-ionic surfactant or a non-ionic surfactant system having a phase inversion temperature, as measured at a concentration of 1% in distilled water, between 40 and 70° C., preferably between 45 and 65° C. By a "non-ionic surfactant system" is meant herein a mixture of two or more non-ionic surfactants. Preferred for use herein are non-ionic surfactant systems. They seem to have improved cleaning and finishing properties and stability in product than single non-ionic surfactants.

Phase inversion temperature is the temperature below which a surfactant, or a mixture thereof, partitions preferentially into the water phase as oil-swollen micelles and above which it partitions preferentially into the oil phase as water swollen inverted micelles. Phase inversion temperature can be determined visually by identifying at which temperature cloudiness occurs.

The phase inversion temperature of a non-ionic surfactant or system can be determined as follows: a solution containing 1% of the corresponding surfactant or mixture by weight of the solution in distilled water is prepared. The solution is stirred gently before phase inversion temperature analysis to ensure that the process occurs in chemical equilibrium. The phase inversion temperature is taken in a thermostable bath by immersing the solutions in 75 mm sealed glass test tube. To ensure the absence of leakage, the test tube is weighed before and after phase inversion temperature measurement. The temperature is gradually increased at a rate of less than 1° C. per minute, until the temperature reaches a few degrees below the pre-estimated phase inversion temperature. Phase inversion temperature is determined visually at the first sign of turbidity.

Suitable nonionic surfactants include: i) ethoxylated non-ionic surfactants prepared by the reaction of a monohydroxy alkanol or alkyphenol with 6 to 20 carbon atoms with preferably at least 12 moles particularly preferred at least 16 moles, and still more preferred at least 20 moles of ethylene oxide per mole of alcohol or alkylphenol; ii) alcohol alkoxylated surfactants having a from 6 to 20 carbon atoms and at least one ethoxy and propoxy group. Preferred for use herein are mixtures of surfactants i) and ii).

Another suitable non-ionic surfactants are epoxy-capped poly(oxyalkylated) alcohols represented by the formula:

$$R_1O[CH_2CH(CH_3)O]_x[CH_2CH_2O]_y[CH_2CH(OH)R_2] \quad (I)$$

wherein $R_1$ is a linear or branched, aliphatic hydrocarbon radical having from 4 to 18 carbon atoms; $R_2$ is a linear or branched aliphatic hydrocarbon radical having from 2 to 26 carbon atoms; x is an integer having an average value of from 0.5 to 1.5, more preferably about 1; and y is an integer having a value of at least 15, more preferably at least 20.

Preferably non-ionic surfactants and/or system to use as anti-redeposition agents herein have a Draves wetting time of less than 360 seconds, preferably less than 200 seconds, more preferably less than 100 seconds and especially less than 60 seconds as measured by the Draves wetting method (standard method ISO 8022 using the following conditions; 3-g hook, 5-g cotton skein, 0.1% by weight aqueous solution at a temperature of 25° C.).

Preferred non-ionic surfactants for use herein are selected from the group consisting of:

a) a non-ionic surfactant of formula RO(CH2CH2O)xH wherein where R is iso-C13H27 and x is 7;

b) a non-ionic surfactant of formula RO(CH2CH2O)x (CH2CH2CH2O)yH wherein where R is a C6-C14 alkyl and x and y are from 5 to 20; and c) mixtures thereof.

A mixture of a) and b) is especially preferred for use herein.

Amine oxides surfactants are also useful in the present invention as anti-redeposition surfactants include linear and branched compounds having the formula:

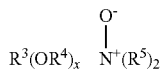

wherein $R^3$ is selected from an alkyl, hydroxyalkyl, acylamidopropoyl and alkyl phenyl group, or mixtures thereof, containing from 8 to 26 carbon atoms, preferably 8 to 18 carbon atoms; $R^4$ is an alkylene or hydroxyalkylene group containing from 2 to 3 carbon atoms, preferably 2 carbon atoms, or mixtures thereof; x is from 0 to 5, preferably from 0 to 3; and each $R^5$ is an alkyl or hydroxyalkyl group containing from 1 to 3, preferably from 1 to 2 carbon atoms, or a polyethylene oxide group containing from 1 to 3, preferable 1, ethylene oxide groups. The $R^5$ groups can be attached to each other, e.g., through an oxygen or nitrogen atom, to form a ring structure.

These amine oxide surfactants in particular include $C_{10}$-$C_{18}$ alkyl dimethyl amine oxides and $C_8$-$C_{18}$ alkoxy ethyl dihydroxyethyl amine oxides. Examples of such materials include dimethyloctylamine oxide, diethyldecylamine oxide, bis-(2-hydroxyethyl)dodecylamine oxide, dimethyldodecylamine oxide, dipropyltetradecylamine oxide, methylethylhexadecylamine oxide, dodecylamidopropyl dimethylamine oxide, cetyl dimethylamine oxide, stearyl dimethylamine oxide, tallow dimethylamine oxide and dimethyl-2-hydroxyoctadecylamine oxide. Preferred are $C_{10}$-$C_{18}$ alkyl dimethylamine oxide, and $C_{10-18}$ acylamido alkyl dimethylamine oxide.

Non-ionic surfactants may be present in amounts from 0 to 20%, preferably from 1% to 15%, and most preferably from 2% to 12% by weight of the composition.

Anionic Surfactant

Anionic surfactants include, but are not limited to, those surface-active compounds that contain an organic hydrophobic group containing generally 8 to 22 carbon atoms or generally 8 to 18 carbon atoms in their molecular structure and at least one water-solubilizing group preferably selected from sulfonate, sulfate, and carboxylate so as to form a water-soluble compound. Usually, the hydrophobic group will comprise a C8-C 22 alkyl, or acyl group. Such surfactants are employed in the form of water-soluble salts and the salt-forming cation usually is selected from sodium, potassium, ammonium, magnesium and mono-, di- or tri-alkanolammonium, with the sodium cation being the usual one chosen.

The anionic surfactant can be a single surfactant or a mixture of anionic surfactants. Preferably the anionic surfactant comprises a sulphate surfactant, more preferably a sulphate surfactant selected from the group consisting of alkyl sulphate, alkyl alkoxy sulphate and mixtures thereof. Preferred alkyl alkoxy sulphates for use herein are alkyl ethoxy sulphates.

Alkyl Ether Sulphate (AES) Surfactants

The alkyl ether sulphate surfactant has the general formula (I)

(I)

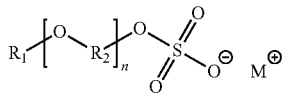

having an average alkoxylation degree (n) of from about 0.1 to about 8, 0.2 to about 5, even more preferably from about 0.3 to about 4, even more preferably from about 0.8 to about 3.5 and especially from about 1 to about 3.

The alkoxy group ($R_2$) could be selected from ethoxy, propoxy, butoxy or even higher alkoxy groups and mixtures thereof. Preferably, the alkoxy group is ethoxy. When the alkyl ether sulphate surfactant is a mixture of surfactants, the alkoxylation degree is the weight average alkoxylation degree of all the components of the mixture (weight average alkoxylation degree). In the weight average alkoxylation degree calculation the weight of alkyl ether sulphate surfactant components not having alkoxylated groups should also be included.

Weight average alkoxylation degree
$n$=($x1$*alkoxylation degree of surfactant 1+$x2$*alkoxylation degree of surfactant 2+ . . . )/($x1$+$x2$+ . . . )

wherein x1, x2, are the weights in grams of each alkyl ether sulphate surfactant of the mixture and alkoxylation degree is the number of alkoxy groups in each alkyl ether sulphate surfactant.

The hydrophobic alkyl group ($R_1$) can be linear or branched. Most suitable the alkyl ether sulphate surfactant to be used in the detergent of the present invention is a branched alkyl ether sulphate surfactant having a level of branching of from about 5% to about 40%, preferably from about 10% to about 35% and more preferably from about 20% to about 30%. Preferably, the branching group is an alkyl. Typically, the alkyl is selected from methyl, ethyl, propyl, butyl, pentyl, cyclic alkyl groups and mixtures thereof. Single or multiple alkyl branches could be present on the main hydrocarbyl chain of the starting alcohol(s) used to produce the alkyl ether sulpahte surfactant used in the detergent of the invention.

The branched alkyl ether sulphate surfactant can be a single sulphate surfactant or a mixture of sulphate surfactants. In the case of a single sulphate surfactant the percentage of branching refers to the weight percentage of the hydrocarbyl chains that are branched in the original alcohol from which the sulphate surfactant is derived.

In the case of a sulphate surfactant mixture the percentage of branching is the weight average and it is defined according to the following formula:

Weight average of branching (%)=[($x1$*wt % branched alcohol 1 in alcohol 1+$x2$*wt % branched alcohol 2 in alcohol 2+ . . . )/($x1$+$x2$+ . . . )]*100 wherein x1, x2, are the weight in grams of each alcohol in the total alcohol mixture of the alcohols which were used as starting material for the AES surfactant for the detergent of the invention. In the weight average branching degree calculation the weight of AES surfactant components not having branched groups should also be included.

Preferably the anionic surfactant of this invention is not purely based on a linear alcohol, but has some alcohol content that contains a degree of branching. Without wishing to be bound by theory it is believed that branched surfactant drives stronger starch cleaning, particularly when used in combination with an α-amylase, based on its surface packing.

Alkyl ether sulphates are commercially available with a variety of chain lengths, ethoxylation and branching degrees, examples are those based on Neodol alcohols ex the Shell company, Lial—Isalchem and Safol ex the Sasol company, natural alcohols ex The Procter & Gamble Chemicals company.

Preferably, the alkyl ether sulfate is present from about 0.05% to about 20%, preferably from about 0.1% to about 8%, more preferably from about 1% to about 6%, and most preferably from about 2% to about 5% by weight of the composition.

Suds Suppressor

Suds suppressors suitable for use herein include an alkyl phosphate ester suds suppressor, a silicone suds suppressor, or combinations thereof. Suds suppressor technology and other defoaming agents useful herein are documented in "Defoaming, Theory and Industrial Applications," Ed., P. R. Garrett, Marcel Dekker, N.Y., 1973, incorporated herein by reference.

Suds suppressors are preferably included in the composition of the invention, especially when the composition comprises anionic surfactant. The suds suppressor is included in the composition at a level of from about 0.0001% to about 10%, preferably from about 0.001% to about 5%, more preferably from about 0.01% to about 1.5% and especially from about 0.01% to about 0.5%, by weight of the composition.

A preferred suds suppressor is a silicone based suds suppressor. Silicone suds suppressor technology and other defoaming agents useful herein are extensively documented in "Defoaming, Theory and Industrial Applications", Ed., P. R. Garrett, Marcel Dekker, N.Y., 1973, ISBN 0-8247-8770-6, incorporated herein by reference. See especially the chapters entitled "Foam control in Detergent Products" (Ferch et al) and "Surfactant Antifoams" (Blease et al). See also U.S. Pat. Nos. 3,933,672 and 4,136,045. A preferred silicone based suds suppressors is polydimethylsiloxanes having trimethylsilyl, or alternate end blocking units as the silicone. These may be compounded with silica and/or with surface-active non-silicon components, as illustrated by a suds suppressor comprising 12% silicone/silica, 18% stearyl alcohol and 70% starch in granular form. A suitable commercial source of the silicone active compounds is Dow Corning Corp. Silicone based suds suppressors are useful in that the silica works well to suppress the foam generated by the soils and surfactant Another suitable silicone based suds suppressor comprises solid silica, a silicone fluid or a silicone resin. The silicone based suds suppressor can be in the form of a granule or a liquid. Another silicone based suds suppressor comprises dimethylpolysiloxane, a hydrophilic polysiloxane compound having polyethylenoxy-propylenoxy group in the side chain, and a micro-powdery silica.

A phosphate ester suds suppressor may also be used. Suitable alkyl phosphate esters contain from 16-20 carbon atoms. Such phosphate ester suds suppressors may be monostearyl acid phosphate or monooleyl acid phosphate or salts thereof, preferably alkali metal salts.

Other suitable suds suppressors are calcium precipitating fatty acid soaps. However, it has been found to avoid the use of simple calcium-precipitating soaps as antifoams in the present composition as they tend to deposit on dishware. Indeed, fatty acid based soaps are not entirely free of such problems and the formulator will generally choose to minimize the content of potentially depositing antifoams in the instant composition.

Preferably the composition of the invention comprises enzymes, more preferably amylases and proteases.

Enzyme-related Terminology

Nomenclature for Amino Acid Modifications

In describing enzyme variants herein, the following nomenclature is used for ease of reference:

Original amino acid(s):position(s):substituted amino acid(s).

According to this nomenclature, for instance the substitution of glutamic acid for glycine in position 195 is shown as G195E. A deletion of glycine in the same position is shown as G195*, and insertion of an additional amino acid residue such as lysine is shown as G195GK. Where a specific enzyme contains a "deletion" in comparison with other enzyme and an insertion is made in such a position this is indicated as *36D for insertion of an aspartic acid in position 36. Multiple mutations are separated by pluses, i.e.: S99G+V102N, representing mutations in positions 99 and 102 substituting serine and valine for glycine and asparagine, respectively. Where the amino acid in a position (e.g. 102) may be substituted by another amino acid selected from a group of amino acids, e.g. the group consisting of N and I, this will be indicated by V102N/I.

In all cases, the accepted IUPAC single letter or triple letter amino acid abbreviation is employed.

Where multiple mutations are employed they are shown with either using a "+" or a "/", so for instance either S126C+P127R+S128D or S126C/P127R/S128D would indicate the specific mutations shown are present in each of positions 126, 127 and 128.

Amino Acid Identity

The relatedness between two amino acid sequences is described by the parameter "identity". For purposes of the present invention, the alignment of two amino acid sequences is determined by using the Needle program from the EMBOSS package (http://emboss.org) version 2.8.0. The Needle program implements the global alignment algorithm described in Needleman, S. B. and Wunsch, C. D. (1970) J. Mol. Biol. 48, 443-453. The substitution matrix used is BLOSUM62, gap opening penalty is 10, and gap extension penalty is 0.5.

The degree of identity between an amino acid sequence of an enzyme used herein ("invention sequence") and a different amino acid sequence ("foreign sequence") is calculated as the number of exact matches in an alignment of the two sequences, divided by the length of the "invention sequence" or the length of the "foreign sequence", whichever is the shortest. The result is expressed in percent identity. An exact match occurs when the "invention sequence" and the "foreign sequence" have identical amino acid residues in the same positions of the overlap. The length of a sequence is the number of amino acid residues in the sequence.

Protease

Preferred proteases for use herein have an isoelectric point of from about 4 to about 9, preferably from about 4 to about 8, most preferably from about 4.5 to about 6.5. Proteases with this isoelectric point present good activity in the wash liquor provided by the composition of the invention. As used herein, the term "isoelectric point" refers to electrochemical properties of an enzyme such that the enzyme has a net charge of zero as calculated by the method described below.

Preferably the protease of the composition of the invention is an endoprotease, by "endoprotease" is herein understood a protease that breaks peptide bonds of non-terminal amino acids, in contrast with exoproteases that break peptide bonds from their end-pieces.

Isoelectric Point

The isoelectric point (referred to as IEP or pI) of an enzyme as used herein refers to the theoretical isoelectric point as measured according to the online pI tool available from ExPASy server at the following web address:

http://web.expasy.org/compute_pi/

The method used on this site is described in the below reference:

Gasteiger E., Hoogland C., Gattiker A., Duvaud S., Wilkins M. R., Appel R. D., Bairoch A.; Protein Identification and Analysis Tools on the ExPASy Server;

(In) John M. Walker (ed): The Proteomics Protocols Handbook, Humana Press (2005). Preferred proteases for use herein are selected from the group consisting of a metalloprotease, a cysteine protease, a neutral serine protease, an aspartate protease and mixtures thereof.

Metalloproteases

Metalloproteases can be derived from animals, plants, bacteria or fungi. Suitable metalloprotease can be selected from the group of neutral metalloproteases and *Myxobacter* metalloproteases. Suitable metalloproteases can include collagenases, hemorrhagic toxins from snake venoms and thermolysin from bacteria. Preferred thermolysin enzyme variants include an M4 peptidase, more preferably the thermolysin enzyme variant is a member of the PepSY~Peptidase_M4~Peptidase_M4_C family Preferred metalloproteases include thermolysin, matrix metalloproteinases and those metalloproteases derived from *Bacillus subtilis, Bacillus thermoproteolyticus, Geobacillus stearothermophilus* or *Geobacillus* sp., or *Bacillus amyloliquefaciens*, as described in US PA 2008/0293610A1. A specially preferred metalloprotease belongs to the family EC3.4.24.27.

Further suitable metalloproteases are the thermolysin variants described in WO2014/71410. In one aspect the metalloprotease is a variant of a parent protease, said parent protease having at least 50% or 60%, or 80%, or 85% or 90% or 95% or 96% or 97% or 98% or 99% or even 100% identity to the proteases disclosed in WO 2014/071410 including those with substitutions at one or more of the following sets of positions versus the proteases disclosed in WO 2014/071410:

(a) 2, 26, 47, 53, 87, 91,96, 108, 118, 154, 179, 197, 198, 199, 209, 211, 217, 219, 225, 232, 256, 257, 259, 261, 265, 267, 272,276, 277, 286, 289, 290, 293, 295, 298, 299, 300, 301, 303, 305, 308, 311 and 316;

(b) 1, 4, 17, 25, 40, 45, 56, 58, 61, 74, 86, 97, 101, 109, 149, 150 , 158, 159, 172, 181, 214, 216, 218, 221, 222, 224, 250, 253, 254, 258, 263, 264, 266, 268, 271, 273, 275, 278, 279, 280, 282, 283, 287, 288, 291, 297, 302, 304, 307 and 312;

(c) 5, 9, 11, 19, 27, 31, 33, 37, 46, 64, 73, 76, 79, 80, 85, 89, 95, 98, 99, 107, 127, 129, 131, 137, 141, 145, 148, 151, 152, 155, 156, 160, 161, 164, 168 , 171, 176, 180, 182, 187, 188, 205, 206, 207, 210, 212, 213, 220, 227, 234 , 235, 236, 237, 242, 244, 246, 248, 249, 252, 255, 270, 274, 284, 294, 296, 306, 309, 310, 313, 314 and 315;

(d) 3, 6, 7, 20, 23, 24, 44, 48, 50, 57, 63, 72, 75, 81, 92, 93, 94, 100, 102, 103, 104, 110, 117, 120, 134, 135, 136, 140, 144, 153, 173, 174, 175, 178, 183, 185, 189, 193, 201, 223, 230, 238, 239, 241, 247, 251, 260, 262, 269, and 285;

(e) 17, 19, 24, 25, 31, 33, 40, 48, 73, 79, 80, 81, 85, 86, 89, 94, 109, 117, 140, 141, 150, 152, 153, 158, 159, 160, 161, 168, 171, 174, 175, 176, 178, 180, 181, 182, 183, 189, 205, 206, 207, 210, 212, 213, 214, 218, 223, 224,227, 235, 236, 237, 238, 239, 241, 244, 246, 248, 249, 250, 251, 252, 253, 254, 255, 258, 259, 260, 261, 262, 266, 268, 269, 270, 271, 272, 273, 274, 276, 278, 279, 280, 282, 283, 294, 295, 296, 297, 300, 302, 306, 310 and 312;

(f) 1, 2, 127, 128, 180, 181, 195, 196, 197, 198, 199, 211, 223, 224, 298, 299, 300, and 316 all relative to the proteases disclosed in WO 2014/071410.

Further suitable metalloproteases are the NprE variants described in WO2007/044993, WO2009/058661 and US 2014/0315775. In one aspect the protease is a variant of a parent protease, said parent protease having at least 45%, or 60%, or 80%, or 85% or 90% or 95% or 96% or 97% or 98% or 99% or even 100% identity to of the proteases disclosed in US 2014/0315775 including those with substitutions at one or more of the following sets of positions versus said sequence:

S23, Q45, T59, S66, 5129, F130, M138, V190, 5199, D220, K211, and G222,

Another suitable metalloprotease is a variant of a parent protease, said parent protease having at least 60%, or 80%, or 85% or 90% or 95% or 96% or 97% or 98% or 99% or even 100% identity to the proteases disclosed in US 2014/0315775 including those with substitutions at one or more of the following sets of positions versus the proteases disclosed in US 2014/0315775: Q45E, T59P, 566E, S129I, S129V, F130L, M138I, V190I, S199E, D220P, D220E, K211V, K214Q, G222C, M138L/D220P, F130L/D220P, 51291/D220P, V1901/D220P, M138L/V1901/D220P, 5129I/V1901, S129V/V190I, S129V/D220P, S1291/F130L/D220P, TOO4V/S023N, TO59K/S66Q/S1291, TO59R/S66N/S1291, S1291/F130L/M138L/V1901/D220P and TO59K/S66Q/S129V.

Especially preferred metalloproteases for use herein belong to EC classes EC 3.4.22 or EC3.4.24, more preferably they belong to EC classes EC3.4.22.2, EC3.4.24.28 or EC3.4.24.27. The most preferred metalloprotease for use herein belong to EC3.4.24.27.

Suitable commercially available metalloprotease enzymes include those sold under the trade names Neutrase® by Novozymes A/S (Denmark), the Corolase® range including Corolase® 2TS, Corolase® N, Corolase® L10, Corolase® LAP and Corolase® 7089 from AB Enzymes, Protex 14L and Protex 15L from DuPont (Palo Alto, Calif.), those sold as thermolysin from Sigma and the Thermoase range (PC10F and C100) and thermolysin enzyme from Amano enzymes.

The composition of the invention preferably comprises from 0.001 to 2%, more preferably from 0.003 to 1%, more preferably from 0.007 to 0.3% and especially from 0.01 to 0.1% by weight of the composition of active protease.

Amylase

Amylases for use herein are preferably low temperature amylases. Compositions comprising low temperature amylases allow for a more energy efficient dishwashing processes without compromising in cleaning.

As used herein, "low temperature amylase" is an amylase that demonstrates at least 1.2, preferably at least 1.5 and more preferably at least 2 times the relative activity of the reference amylase at 25° C. As used herein, the "reference amylase" is the wild-type amylase of *Bacillus licheniformis*, commercially available under the tradename of Termamyl™ (Novozymes A/S). As used herein, "relative activity" is the fraction derived from dividing the activity of the enzyme at the temperature assayed versus its activity at its optimal temperature measured at a pH of 9.

Amylases include, for example, α-amylases obtained from *Bacillus*. Amylases of this invention preferably display some α-amylase activity. Preferably said amylases belong to EC Class 3.2.1.1.

Amylases for use herein, including chemically or genetically modified mutants (variants), are amylases possessing at least 60%, or 70%, or 80%, or 85%, or 90%, preferably 95%, more preferably 98%, even more preferably 99% and especially 100% identity, with those derived from *Bacillus Licheniformis, Bacillus amyloliquefaciens, Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334). Suitable amylases include those derived from the sp. 707, sp. 722 or AA560 parent wild-types.

Preferred amylases include the variants of a parent amylase, said parent amylase having at least 60%, preferably 80%, more preferably 85%, more preferably 90%, more preferably 95%, more preferably 96%, more preferably 97%, more preferably 98%, more preferably 99% and specially 100% identity to the amylases disclosed in WO2006/002643. The variant amylase preferably further comprises one or more substitutions and/or deletions in the following positions versus the amylases disclosed in WO2006/002643: 9, 26, 30, 33, 82, 37, 106, 118, 128, 133, 149, 150, 160, 178, 182, 186, 193, 195, 202, 203, 214, 231, 256, 257, 258, 269, 270, 272, 283, 295, 296, 298, 299, 303, 304, 305, 311, 314, 315, 318, 319, 320, 323, 339, 345, 361, 378, 383, 419, 421, 437, 441, 444, 445, 446, 447, 450, 458, 461, 471, 482, 484 and preferably the variant amylase comprises the deletions in one or both of the 183 and 184 positions.

Preferred amylases comprise one or both deletions in positions equivalent to positions 183 and 184 of the amylases disclosed in WO2006/002643.

Preferred commercially available amylases for use herein are STAINZYME®, STAINZYME PLUS®, STAINZYME ULTRA®, EVEREST® and NATALASE® (Novozymes A/S) and RAPIDASE, POWERASE® and the PREFERENZ S® series, including PREFERENZ S100® (DuPont).

The composition of the invention preferably comprises from 0.001 to 2%, more preferably from 0.003 to 1%, more preferably from 0.007 to 0.3% and especially from 0.01 to 0.1% by weight of the composition of active amylase.

Other Enzymes

Preferably the composition of the invention further comprises one or more enzymes selected from the group consisting of an α-amylase, a β-amylase, a pullulanase, a protease, a lipase, a cellulase, an oxidase, a phospholipase, a perhydrolase, a xylanase, a pectate lyase, a pectinase, a galacturanase, a hemicellulase, a xyloglucanase, a mannanase and a mixture thereof.

Unit Dose Form

The composition of the invention is suitable to be presented in unit-dose form. Products in unit dose form include tablets, capsules, sachets, pouches, injection moulded containers, etc. Preferred for use herein are tablets and detergents wrapped with a water-soluble film (including wrapped tablets, capsules, sachets, pouches) and injection moulded containers. Preferably the water-soluble film is a polyvinyl alcohol, preferably comprising a bittering agent. The detergent composition of the invention is preferably in the form of a water-soluble multi-compartment pack.

Preferred packs comprise at least two side-by-side compartments superposed onto another compartment. This disposition contributes to the compactness, robustness and strength of the pack and additionally, it minimises the amount of water-soluble packing material required. It only requires three pieces of material to form three compartments. The robustness of the pack allows also for the use of very thin films (less than 150 micron, preferably less than 100 micron) without compromising the physical integrity of the pack. The pack is also very easy to use because the compartments do not need to be folded to be used in machine dispensers of fixed geometry. At least two of the compartments of the pack contain two different compositions. By "different compositions" herein is meant compositions that differ in at least one ingredient.

Preferably, at least one of the compartments contains a solid composition, preferably in powder form and another compartment an aqueous liquid composition, the compositions are preferably in a solid to liquid weight ratio of from about 20:1 to about 1:20, more preferably from about 18:1 to about 2:1 and even more preferably from about 15:1 to about 5:1. This kind of pack is very versatile because it can accommodate compositions having a broad spectrum of values of solid:liquid ratio. Particularly preferred have been found to be pouches having a high solid:liquid ratio because many of the detergent ingredients are most suitable for use in solid form, preferably in powder form. The ratio solid:liquid defined herein refers to the relationship between the weight of all the solid compositions and the weight of all the liquid compositions in the pack.

Preferably the two side-by-side compartments contain liquid compositions, which can be the same but preferably are different and another compartment contains a solid composition, preferably in powder form, more preferably a densified powder. The solid composition contributes to the strength and robustness of the pack.

For dispenser fit reasons the unit dose form products herein preferably have a square or rectangular base and a height of from about 1 to about 5 cm, more preferably from about 1 to about 4 cm. Preferably the weight of the solid composition is from about 5 to about 20 grams, more preferably from about 10 to about 15 grams and the total weight of the liquid compositions is from about 0.5 to about 5 grams, more preferably from about 1.5 to about 4 grams.

In preferred embodiments, at least two of the films which form different compartments have different solubility, under the same conditions, releasing the content of the compositions which they partially or totally envelope at different times.

Controlled release of the ingredients of a multi-compartment pouch can be achieved by modifying the thickness of the film and/or the solubility of the film material. The solubility of the film material can be delayed by for example cross-linking the film as described in WO 02/102,955 at pages 17 and 18. Other water-soluble films designed for rinse release are described in U.S. Pat. No. 4,765,916 and U.S. Pat. No. 4,972,017. Waxy coating (see WO 95/29982) of films can help with rinse release. pH controlled release means are described in WO 04/111178, in particular amino-acetylated polysaccharide having selective degree of acetylation. Other means of obtaining delayed release by multi-compartment pouches with different compartments, where the compartments are made of films having different solubility are taught in WO 02/08380.

Alternatively the dissolution of the liquid compartments can be delayed by modification of the liquid that is contained within the film. Use of anionic surfactants, particularly anionic surfactant mixtures that pass through a highly structured phase (such as hexagonal or lamellar) upon addition of water retards the dissolution of the surfactant containing compartment. In one aspect of this invention, one or more compartments comprise anionic surfactant and their release is delayed versus other compartments.

Auto-dosing Delivery Device

The compositions of the invention are extremely useful for dosing elements to be used in an auto-dosing device. The dosing elements comprising the composition of the present invention can be placed into a delivery cartridge as that described in WO 2007/052004 and WO 2007/0833141. The dosing elements can have an elongated shape and set into an array forming a delivery cartridge which is the refill for an auto-dosing dispensing device as described in case WO 2007/051989. The delivery cartridge is to be placed in an auto-dosing delivery device, such as that described in WO 2008/053191.

EXAMPLES

A high pH automatic dishwashing solid composition (Solid composition 1) and three low pH automatic dishwashing solid compositions (Solid Compositions 2, 3 and 4) automatic dishwashing compositions were made as detailed herein below.

| Ingredient | Solid composition 1 wt % |
|---|---|
| Methylglycine diacetic acid (Trilon ® M) | 52 |
| Sodium carbonate | 21 |
| Sodium percarbonate | 19 |
| Acusol ™ 588GF (sulfonated polymer supplied by DowChemical) | 3 |
| Protease granule (10% active) | 2 |
| Amylase granule (1.4% active) | 4 |
| Sodium 1-hydroxyethyidene-1,1-diphosphonate | 1 |
| Processing Aids, minors and fillers | Up to 100% |

A 1% solution of composition 1 in deionsed water at room temperature had a pH of 10.5

| Ingredient | Solid composition 2 % wt | 3 % wt | 4 % wt |
|---|---|---|---|
| Sodium citrate | 23 | 23 | 23 |
| 2-pyridinol-1-oxide | 3 | 3 | 3 |
| Citric acid | 19 | 19 | 19 |
| Sodium 1-hydroxyethyidene-1,1-diphosphonate | 4 | 4 | 4 |
| Sodium percarbonate | 21 | 21 | 21 |
| Protease granule (8.8% active) | 4 | 4 | 4 |
| Amylase granule (1.4% active) | 4 | 4 | 4 |
| Methacrylate amphiphilic copolymer | 0 | 2 | 2 |
| Acusol ™ 588GF (sulfonated polymer supplied by DowChemical) | 0 | 0 | 3 |
| Processing Aids, fillers & minors | Up to 100% | Up to 100% | Up to 100% |

A 1% solution of compositions 2, 3 and 4 in deionsed water at room temperature had a pH of 6.5

| Ingredient | Liquid composition 1 % wt | 2 % wt | 3 % wt |
|---|---|---|---|
| Lutensol ® TO 7 (non-ionic surfactant supplied by BASF) | 41 | 36 | 36 |
| Plurafac ® SLF180 (non-ionic surfactant supplied by BASF) | 34 | 30 | 7 |
| Plurafac ® LF7319 (non-ionic surfactant supplied by BASF) | 0 | 0 | 23 |
| Lutensol ® FP 620 | 0 | 10 | 10 |
| Processing Aids and dye | Up to 100% | Up to 100% | Up to 100% |

Multi Cycle Filming Test

The following test items were used:

| Supplier | Brand/Item Code | Item |
|---|---|---|
| Eternum | Ingres | Stainless steel knife |
| Durobor (or retailers) | Durobor Classic Collection 378/21 | Scotch Glass |
| Luminarc | Authentic Noir | Black Plate |

Additional Ballast Soil 1

To add extra soil stress to the test, a blend of soils is added to the dishwasher, as prepared by the procedure described below

| Ingredient | % content |
|---|---|
| Potato Starch | 5.6 |
| Wheat Flour | 4.5 |
| Vegetable oil | 4.4 |
| Margarine | 4.4 |
| Lard | 4.4 |
| Single Cream | 9.0 |
| Baking Spread | 4.4 |
| Large Eggs | 9.0 |
| Whole Milk | 9.0 |
| Ketchup | 3.0 |
| Mustard | 4.0 |
| Benzoic acid >99% | 0.8 |
| Water (15-18 grains per US gallon) | 37.5 |
| Total | 100 |

Soil Preparation

1. Add water to the potato starch and leave to soak overnight. Then heat in a pan until the gel formed is properly inflated. Leave the pan to cool at room temperature overnight.
2. Weigh out the appropriate amounts of each ingredient.
3. Add the Ketchup and mustard to a bowl and mix vigorously until fully combined, 1 minute.
4. Melt Margarine, lard and baking spread individually in a microwave and allow to cool to room temperature then mix together.
5. Add Wheat Flour and Benzoic acid to a bowl and mix vigorously.
6. Break eggs into a bowl and mix vigorously.
7. Add vegetable oil to the eggs and stir using a hand blender.
8. Mix the cream and milk in a bowl.
9. Add all of the ingredients together into a large container and mix using a blender for ten minutes.
10. Weigh out 50 g batches of this mixture into plastic pots and freeze.

Test wash procedure

Automatic Dishwasher: Miele, model GSL

Wash volume: 5000 ml

Water temperature: Cycles 1-5 55° C., cycles 6-30 65° C.

Water hardness: 3 mmol

Detergent addition: Added into the bottom of the automatic dishwasher after the initial pre-wash is complete.

Additional ballast bottom rack: 12× dinner plates

Additional ballast top rack: 4× plastic containers

Positioning of test items: 4× stainless steel knives in cutlery rack
4× black plates on bottom rack
4× scotch glasses on top rack Additional soil stress: 1×50 g pot of Additional ballast soil 1 added to top rack.

Filming Test

One dose of detergent, comprising 14 g of the solid compositions, and 2.2 g of liquid composition 1 or 4 g of liquid compositions 2, 3 and 4 was added to the automatic dishwasher.

| Example | Composition |
|---|---|
| Formula A | Solid composition 1 + liquid composition 1 |
| Formula B | Solid composition 2 + liquid composition 2 |
| Formula C | Solid composition 3 + liquid composition 2 |
| Formula D | Solid composition 4 + liquid composition 3 |

A dishwasher was loaded with the items as detailed above which were washed using Formulas A, B, C and D respectively. The items were washed 30 times repetitively as detailed above with the same detergent and the items were then graded on a visual scale of 1-5 where 1 is worst amount of filming or spotting present and 5 is no filming or spotting present.

| | Stainless Steel Knife | Black Plate | Scotch Glass |
|---|---|---|---|
| | Filming grade (measured after 30 cycles) | | |
| Formula A (comparative) | 3.5 | 3.0 | 3.5 |
| Formula B (comparative) | 3.1 | 3.8 | 4.0 |
| Formula C | 3.8 | 3.9 | 4.0 |
| Formula D | 4.0 | 4.3 | 4.5 |
| Error | | ±0.25 | |
| | Spotting grade (measured after 5 cycles) | | |
| Formula A (comparative) | 2.5 | 3.0 | 3.5 |
| Formula B (comparative) | 2.8 | 3.3 | 3.5 |
| Formula C | 2.9 | 3.5 | 3.8 |
| Formula D | 3.4 | 4.0 | 5.0 |
| Error | | ±0.25 | |

As can be seen from the above filming and spotting grades, Formulas C and D of this invention have significantly less filming and spotting than Formulas A and B which are outside the scope of this invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. An automatic dishwashing detergent composition having a pH as measured in 1% weight aqueous solution at 25° C. of from about 5 to about 7.5, the composition comprises a soil suspension polymer and a surface-modification surface-substantive polymer, the polymer comprising in copolymerized form from:

i. about 60% to about 99% by weight of the polymer of at least one monoethylenically unsaturated polyalkylene oxide monomer of the formula I (monomer (A))

I

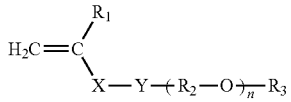

in which the variables have the following meanings:

X is —CH2- or —CO—, if Y is —O—;

X is —CO—, if Y is —NH—;

Y is —O— or —NH—;

R1 is hydrogen or methyl;

R2 are identical or different C2-C6-alkylene radicals;

R3 is H or C1-C4 alkyl;

n is an integer from 3 to 100, ii. from about 1 to about 40% by weight of the cationic polymer of at least one quaternized nitrogen-containing monomer, selected from the group consisting of at least one of the monomers of the formula IIa to IId (monomer (B))

IIa

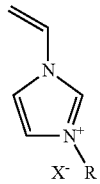

IIb

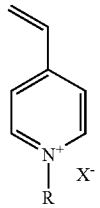

IIc

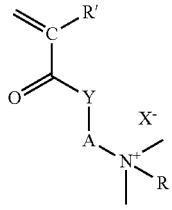

IId

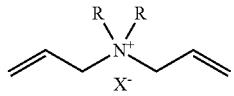

in which the variables have the following meanings:

R is C1-C4 alkyl or benzyl;

R' is hydrogen or methyl;

Y is —O— or —NH—;

A is C1-C6 alkylene;

X—is halide, C1-C4-alkyl sulfate, C1-C4-alkylsulfonate and C1-C4-alkyl carbonate, iii. from about 0 to about 15% by weight of the cationic polymer of at least one anionic monoethylenically unsaturated monomer (monomer (C)), and iv. from about 0 to about 30% by weight of the cationic polymer of at least one other nonionic monoethylenically unsaturated monomer (monomer (D)), and the polymer has a weight average molecular weight (Mw) from about 2,000 to about 500,000 200,000 g/mol.

2. A composition according to claim 1 wherein the composition is substantially builder free.

3. A composition according to claim 1 comprising from about 15% to about 55% by weight of the composition of a pH regulator system wherein the pH regulator system comprises a mixture of an acid and a conjugate salt.

4. A composition according to claim 1 further comprising a dispersant polymer.

5. A composition according to claim 1 further comprising a carboxylated/sulfonated polymer comprising a carboxylic acid monomer and a sulfonated monomer.

6. A composition according to claim 1 wherein the composition comprises a non-ionic surfactant.

7. A composition according to claim 1 wherein the composition comprises a non-ionic surfactant selected from the group consisting of:

a) a non-ionic surfactant of formula RO(CH2CH2O)xH wherein where R is iso-C13H27 and x is 7;

b) a non-ionic surfactant of formula RO(CH2CH2O)x (CH2CH2CH2O)yH wherein where R is a C6-C14 alkyl and x and y are from 5 to 20; and c) mixtures thereof.

8. A composition according to claim 1 wherein the composition comprises from about 5% to about 20% by weight of the composition of surfactant.

9. A composition according to claim 1 comprising bleach wherein the level of bleach is from about 1% to about 40% by weight of the composition.

10. A composition according to claim 1 wherein the composition comprises a metalloprotease.

11. A composition according to claim 1 further comprising a crystal growth inhibitor.

12. A composition according to claim 1 further comprising an alkoxylated polyalkyleneimine.

13. A composition according to claim 1 further comprising an esterified alkyl alkoxylated surfactant of general formula (I)

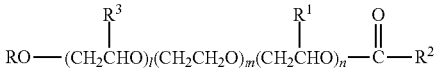

wherein

R is a branched or unbranched alkyl radical having 8 to 16 carbon atoms;

$R^3$, $R^1$ independently of one another, are hydrogen or a branched or unbranched alkyl radical having 1 to 5 carbon atoms;

$R^2$ is an unbranched alkyl radical having 5 to 17 carbon atoms;

l, n independently of one another, are a number from 1 to 5 and m is a number from 13 to 35.

14. A composition according to claim 1 further comprises an iron chelant wherein the iron chelant is selected from the group consisting of siderophores, catechols, enterobactin, hydroxamates, hydroxypyridinones (or hydroxypyridine N-Oxides) and mixtures thereof.

15. A composition according to claim 1 comprising:

(i) from about 1 to about 10% by weight of the composition of the surface-modification surface-substantive polymer;

(ii) from about 15% to about 55% by weight of the composition of a pH regulator system wherein the pH regulator system comprises a mixture of citric acid and citrate;

(iii) from about 5% to about 20% by weight of the composition of bleach;

(iv) from about 1 to about 10% by weight of the composition of a carboxylated/sulfonated polymer; from about 1 to about 10% by weight of the composition of the esterified alkyl alkoxylated surfactant of general formula (I)

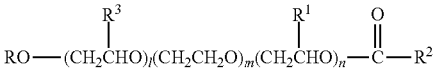

wherein

R is a branched or unbranched alkyl radical having 8 to 16 carbon atoms;

$R^3$, $R^1$ independently of one another, are hydrogen or a branched or unbranched alkyl radical having 1 to 5 carbon atoms;

$R^2$ is an unbranched alkyl radical having 5 to 17 carbon atoms;

l, n independently of one another, are a number from 1 to 5 and m is a number from 13 to 35;

(v) from about 0.1% to about 10% by weight of the composition of HEDP;

(vi) from about 5 to about 15% of non-ionic surfactant;

(vii) and amylase and a protease; and wherein the composition is free or essentially free of builder.

16. A single or multi-compartment water-soluble pouch comprising a composition according to claim 1.

17. A single or multi-compartment water-soluble pouch comprising a composition according to claim 1 wherein the pouch comprises a compartment comprising a powder composition and a compartment comprising a liquid composition and wherein the powder composition comprises the modification surface-substantive polymer.

18. A method of reducing filming and spotting on dishware in automatic dishwashing comprising the step of delivering into a dishwasher a composition according to claim 1.

19. A method of reducing filming and spotting on dishware in automatic dishwashing comprising the step of delivering into a dishwasher a composition according to claim 1 and wherein the dishware is subjected to multi-cycles.

* * * * *